US006446797B1

(12) United States Patent
Shiga

(10) Patent No.: US 6,446,797 B1
(45) Date of Patent: Sep. 10, 2002

(54) BLADE CASE

(75) Inventor: Yoshiyuki Shiga, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 09/950,880

(22) Filed: Sep. 13, 2001

(30) Foreign Application Priority Data

Sep. 14, 2000 (JP) ..... 2000-279880

(51) Int. Cl.[7] ..... B65D 85/02
(52) U.S. Cl. ..... 206/303; 206/349; 206/493
(58) Field of Search ..... 206/303, 349, 206/493, 308.1, 310, 509, 511

(56) References Cited

U.S. PATENT DOCUMENTS 4,903,829 A * 2/1990 Clemens ..... 206/308.1
5,078,266 A * 1/1992 Rackley ..... 206/303
5,361,903 A * 11/1994 Thiele ..... 206/310
5,366,073 A * 11/1994 Turrentine et al. ..... 206/308.1
5,682,988 A * 11/1997 Salisbury ..... 206/303
5,713,463 A * 2/1998 Lakoski et al. ..... 206/308.1
5,819,929 A * 10/1998 Chung ..... 206/308.1
5,894,924 A * 4/1999 Koch ..... 206/308.1

* cited by examiner

*Primary Examiner*—Luan K. Bui
(74) *Attorney, Agent, or Firm*—Smith, Gambrell & Russell, LLP

(57) ABSTRACT

A blade case having a holding means, a bottom wall, a side wall, and a cover means. The holding means and the cover means are connected to each other by a hinge for opening and closing the blade case. A removable blade support means is provided on the center portion of a top surface of the bottom wall of the holding means. A blade pressing down means is provided on the cover means and presses down the blade placed on the blade supporting portion when the blade case is closed. Non-circular protrusions and depressions can also be located on the outside of the blade case to facilitate stacking.

11 Claims, 3 Drawing Sheets

BLADE CASE

FIELD OF THE INVENTION

The present invention relates to a blade case suitable for storing an annular blade, particularly a washer type blade.

DESCRIPTION OF THE PRIOR ART

In the production process of a semiconductor device, a circuit such as an IC or LSI is each formed in a large number of regions arranged in a lattice form on the surface of a substantially disk-like semiconductor wafer and each region having the circuit formed therein is diced along predetermined cutting lines to produce semiconductor chips. Thus, the dicing machine for cutting the semiconductor wafer is provided with an annular blade, as a cutting means, mounted to a rotary spindle. Examples of this blade include a blade produced by binding diamond abrasive grains with a resin bond and having a thickness of around 100 $\mu$m and a blade produced by binding diamond abrasive grains with nickel plating and having a thickness of around 20 $\mu$m. Since all of them are easily broken due to small thickness, they are stored in a hard case and carefully handled until they are mounted to the rotary spindle.

As a blade case heretofore used comprises a circular holding means and a circular cover means to meet a shape of the annular blade, it is liable to roll. Therefore, there is a possibility that the blade case falls from a table and the blade stored therein may be broken. The holding means and the cover means are constructed separately and secured together by an adhesive tape after the blade is stored. Therefore, when the blade is to be mounted to the rotary spindle of the dicing machine, it takes time and labor to handle it, thereby reducing working efficiency and causing such a problem that the blade may be fallen and broken.

To eliminate the above problems, the present applicant proposes a blade case in which a holding means having a center hole support portion to which the center hole of a blade is be fitted and a cover means are formed as a unitary structure through a hinge and a side portion including at least the hinge is formed straight. This blade case is disclosed in JP-A 8-323545.

In use of the blade case disclosed in JP-A 8-323545, there is no problem when a so-called hub blade, which is produced by forming a blade at the periphery of a hub to be mounted to the rotary spindle of a dicing machine, is stored in the blade case, because the blade case can have a structure that the hub can be pressed by the inner wall of a cover means. However, when a so-called washer type blade having no hub for mounting the blade is stored in the blade case, the blade is difficult to fix securely and looseness is produced in the blade case, so that the blade may be broken during transportation. Further, to store blades which differ in the diameter of a center hole, a problem arises in that a plurality of blade cases having center hole support portion corresponding to the types of diameter of the center holes of the blades must be prepared.

SUMMARY OF THE INVENTION

It is an object of the present invention to provide a blade case capable of fixing reliably even a washer type blade therein in a state of it being stored in the case.

It is another object of the present invention to provide a blade case capable of storing blades which differ in the diameter of a center hole by exchanging a part of the component.

To attain the above objects, according to the present invention, there is provided a blade case for storing an annular blade having a center hole, which comprises a holding means having a bottom wall and a side wall formed upright from the outer periphery of the bottom wall and a cover means having a top wall and a side wall extending downward from the outer periphery of the top wall, the side wall being connected with the side wall constituting the holding means by a hinge so that the blade case can be opened or closed, wherein the blade case further comprises:

a blade support means including a center hole support portion which is provided on the center top surface of the bottom wall of the holding means and to which the center hole of the blade is fitted and a blade supporting portion, formed on the outside of the center hole support portion, for placing the blade fitted to the center hole support portion;

a blade pressing-down means which is provided on the cover means and presses down the blade placed on the blade supporting portion, in a closed state that the holding means is closed with the cover means; and a locking means which are formed on the side wall of the holding means and the side wall of the cover means and keep the closed state that the holding means is closed with the cover means.

The above blade pressing-down means comprises a blade pressing-down portion for pressing down the blade and a spring means for urging the blade pressing-down portion. Preferably, the center hole support portion and the blade supporting portion constituting the above blade support means are formed as a unitary structure and can be attached to and detached from the bottom wall of the above holding means. Further it is preferable that the peripheries of the above holding means and cover means have at least one straight portion and the holding means and the cover means are connected to each other by a hinge at the straight portion so that the blade case can be opened or closed and that a non-circular depression is formed in the bottom wall of the above holding means and a non-circular protrusion to be fitted to the non-circular depression is formed on the top wall of the above cover means. Preferably, the holding means, cover means and hinge are molded from polypropylene as a unitary structure.

DETAILED DESCRIPTION OF THE PREFERRED EMBODIMENTS

Preferred embodiments of a blade case constituted according to the present invention will be described in detail hereinafter with reference to the accompanying drawings.

Figure 1:
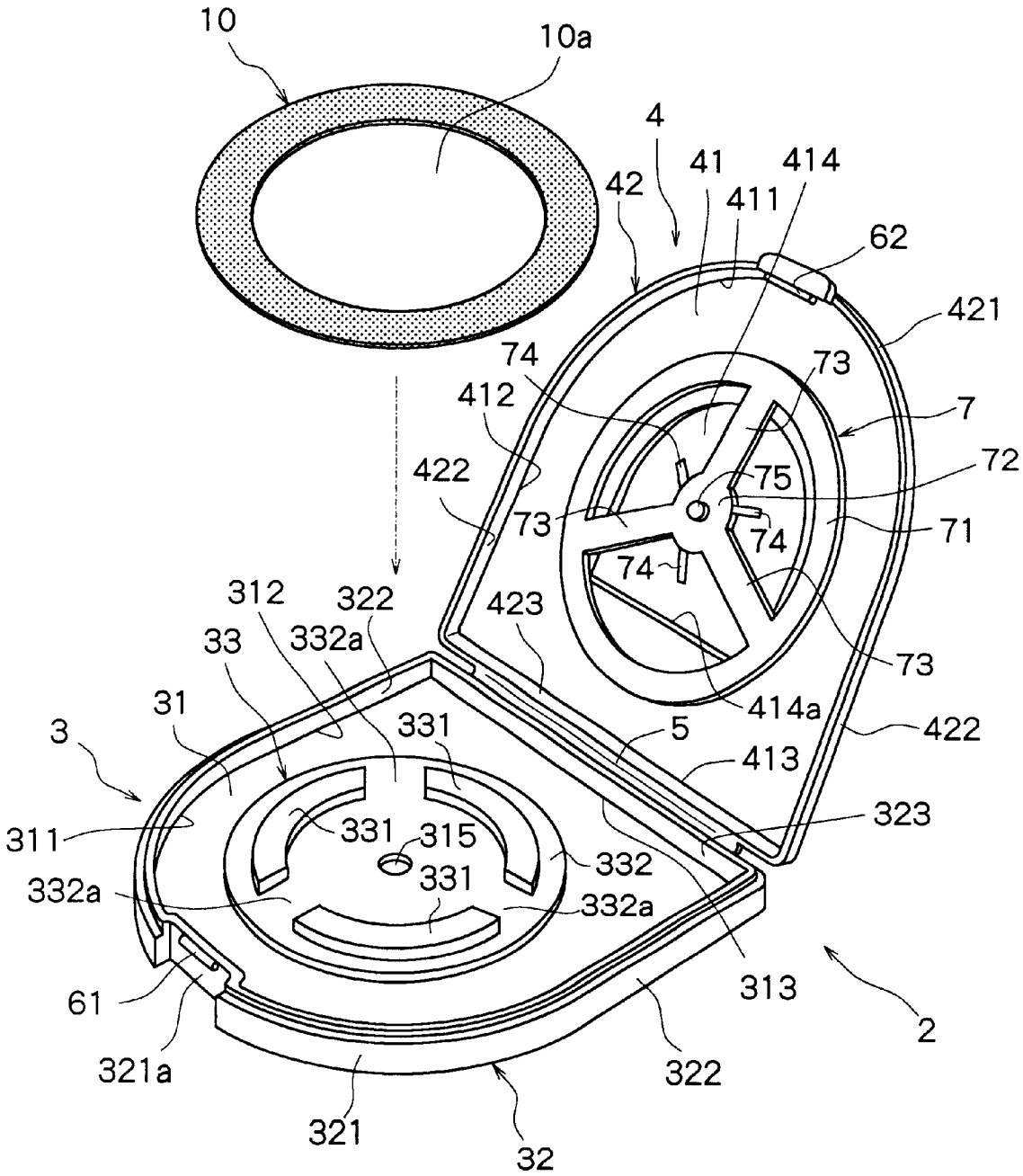
FIG. 1 is a perspective view of an embodiment of a blade case constituted according to the present invention.
Figure 2:
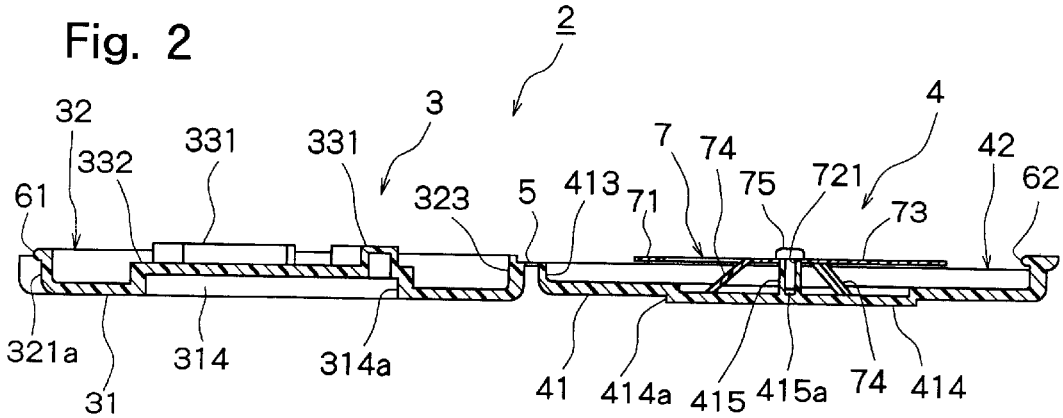
FIG. 2 is a sectional view of the blade case shown in FIG. 1.

FIG. 1 is a perceptive view of a blade case 2 constituted according to the present invention in a state a cover means thereof being opened and a washer type blade 10 to be stored in the blade case, and FIG. 2 is a sectional view of the blade case shown in FIG. 1.

The blade case 2 in the illustrated embodiment comprises a holding means 3 and a cover means 4 connected to the holding means 3 by a hinge 5 so that it can be opened or closed and is molded from a suitable synthetic resin as a unitary structure. The synthetic resin for the integrated molding of the blade case 2 is desirably polypropylene which allows to be recycled.

The holding means 3 has a bottom wall 31 and a side wall 32 formed upright from the periphery of the bottom wall 31. The periphery of the bottom wall 31 consists of an arcuate portion 311, parallel portions 312 and 312 extending from both ends of the arcuate portion 311 in parallel to each other and a straight portion 313 connecting the parallel portions 312 and 312. The side wall 32 also has an arcuate portion 321 corresponding to the arcuate portion 311 of the bottom wall 31, parallel portions 322 and 322 corresponding to the parallel portions 312 and 312 of the bottom wall 31 and a straight portion 323 corresponding to the straight portion 313 of the bottom wall 31. A blade support means 33 for supporting a blade 10 is provided on the center top surface of the bottom wall 31 formed as described above. The blade support means 33 consists of a center hole support portion 331 which protrude from the top of the bottom wall 31 and to which the center hole 10*a* of the blade 10 is fitted and a blade support portion 332 which protrudes from the top of the bottom wall 31 on the outside of the center hole support portion 331 and places the blade 10 fitted to the center hole support portion 331. In the embodiment shown in FIG. 1 and FIG. 2, the blade support means 33 is molded, as a unitary structure, together with the bottom wall 31 of the holding means 3. The center hole support portion 331 are formed by dividing an annular protruding portion into three by three escape depressions 332*a* provided at angular intervals of about 120° in the illustrated embodiment and the outer peripheral surfaces thereof are formed as arcuate surfaces having a radius corresponding to the center hole 10*a* of the blade 10. The three escape depressions 332*a* are provided to prevent an interference with leg portions constituting a blade pressing-down means, that is described later. The blade support portion 332 provided on the outside of the center hole support portion 331 is circular and has an outer diameter smaller than the outer diameter of the blade 10 and a height smaller than the height of the center hole support portion 331. In the embodiment shown in FIG. 1 and FIG. 2, a non-circular depression 314 shaped like letter D having a straight portion 314*a* is formed in the center portion of the under surface of the bottom wall 31. In the embodiment shown in FIG. 1 and FIG. 2, an escape hole 315 for preventing an interference with a stopper which constitutes the blade pressing-down means, that will be described later is formed in the center portion of the bottom wall 31.

The above cover means 4 has a top wall 41 and a side wall 42 extending downward from the periphery of the top wall 41. The top wall 41 is formed substantially the same in shape as the bottom wall 31 constituting the above holding means 3 and the periphery thereof consists of an arcuate portion 411, parallel portions 412 and 412 extending from both ends of the arcuate portion 411 in parallel to each other and a straight portion 413 connecting the parallel portions 412 and 412. The side wall 42 also has an arcuate portion 421 corresponding to the arcuate portion 411 of the top wall 41, parallel portions 422 and 422 corresponding to the parallel portions 412 and 412 of the top wall 41 and a straight portion 423 corresponding to the straight portion 413 of the top wall 41. In the embodiment shown in FIG. 1 and FIG. 2, a non-circular D-shaped protrusion 414 having a straight portion 414*a* to be fitted to the non-circular D-shaped depression 314 formed in the bottom wall 31 constituting the above holding means 3 is formed on the center top surface of the top wall 41. Therefore, when a plurality of blade cases 2 are piled up together, the depression 314 formed in the bottom wall 31 constituting the holding means 3 is fitted to a protrusion 414 formed on the top wall 41 constituting the cover means 4 of a blade case 2 below, and the protrusion 414 formed on the top wall 41 constituting the cover means 4 is fitted to a depression 314 formed in the bottom wall 31 constituting the holding means 3 of a blade case 2 above so that the blade cases 2 can be piled up without falling off or dislocating. Since the above depression 314 and the above protrusion 414 are shaped like letter D (non-circular) having a straight portion, the rotations of the blade cases which are placed one upon the other with the depression 314 fitted to the protrusion 414 are restricted and the blade cases are kept piled up one upon the other, which is convenient for transportation and storage.

As the straight portion 323 of the side wall 32 of the above-described holding means 3 and the straight portion 423 of the side wall 42 of the above-described cover means 4 are connected to each other by the hinge 5 so that the blade case 2 can be opened or closed, the blade case 2 which is constituted by the holding means 3 and the cover means 4 has a straight portion at the periphery, it hardly rolls and can be prevented from falling from a table, for example.

Figure 3:
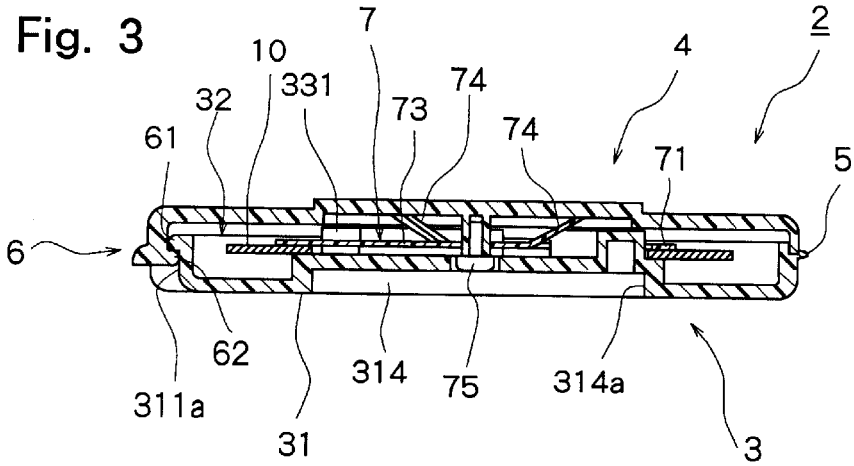
FIG. 3 is a sectional view showing a state of a blade being stored in the blade case shown in FIG. 1.

The holding means 3 and cover means 4 constituted as described above are provided with a locking means 6 for keeping a closed state that the holding means 3 is closed with the cover means 4 as shown in FIG. 3. The locking means 6 consist of a locking projection 61 formed on a flat portion 321*a* provided at the center of the arcuate portion 321 constituting the side wall 32 of the holding means 3 and a locking piece 62 to be engaged with the locking projection 61 in the above closed state, which is provided at the center of the arcuate portion 421 constituting the side wall 42 of the cover means 4. To release the above closed state of the locking means 6, the lower end of the locking piece 61 is dislocated outward to disengage the locking projection 61 from the locking piece 62.

Figure 4:
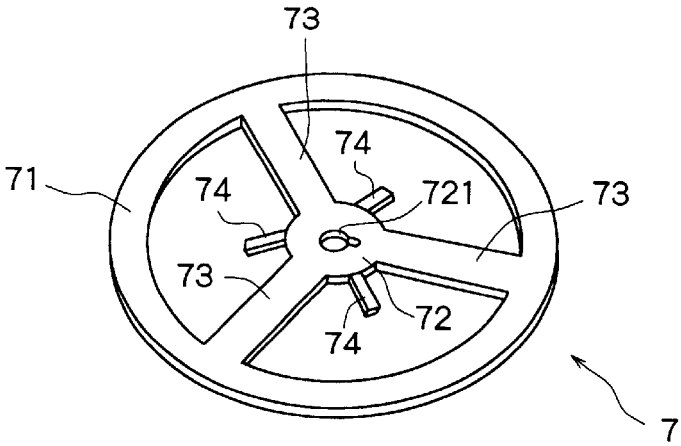
FIG. 4 is a perspective view of a blade pressing-down means provided in the blade case shown in FIG. 1.

The blade case 2 in the illustrated embodiment is provided with the blade pressing-down means 7 which is formed on the cover means 4 and presses the blade 10 mounted on the blade support portion 332 of the blade support means 33 in a close state that the holding means 3 is closed with the cover means 4 as shown in FIG. 3. This blade pressing-down means 7 will be described also with reference to FIG. 4. The blade pressing-down means 7 has an annular blade pressing-down portion 71 having substantially the same outer diameter as the blade support portion 332 provided on the bottom wall 31 of the above holding means 3, a center support portion 72 provided at the center of the above annular blade pressing-down portion 71, three leg portions 73 provided at angular intervals of approximately 120° to connect the center support portion 72 and the annular blade pressing-down portion 71, and three spring means 74 projecting slantwise upward from the center support portion 72 and provided between adjacent leg portions 73. These portions are molded, as a unitary structure, from a synthetic resin such as polypropylene. The width of each of the above three leg portions 73 is smaller than the width of the three escape depressions 332*a* provided between adjacent center hole support portion 331 and the leg portions 73 are fitted into the respective depressions 332*a* in a closed state that the holding means 3 is closed with the cover means 4 as shown in FIG. 3. A fitting hole 721 to be fitted to a support column 415 projecting from the center portion of the under surface of the top wall 41 constituting the cover means 4 is formed in the center of the center support portion 72 constituting the above blade pressing-down means 7. The fitting hole 721 of the thus constituted blade pressing-down means 7 is fitted to the support column 415 while the ends of the spring means 74 being directed toward the top wall 41 side. By press fitting the stopper 75 into a stopper hole 415*a* formed in the center of the support column 415, the blade pressing-down means 7 can be secured to the cover means 4.

The blade case 2 in the embodiment shown in FIGS. 1 to 4 is constituted as described above, and the storing of the blade 10 will be described hereinafter. In a state that the cover means 4 of the blade case 2 is opened as shown in FIG. 1 or FIG. 2, the center hole 10*a* of the blade 10 is fitted to the center hole support portion 331 formed on the bottom wall 31 of the holding means 3 to place the under surface of the blade 10 on the blade support portion 332. When the cover means 4 is turned on the hinge 5 and superposed on the holding means 3 as shown in FIG. 3 to close the blade case 2, the locking piece 62 provided on the cover means 4 engages with the locking projection 61 provided on the holding means 3 to keep the closed state. At this point, the annular blade pressing-down portion 71 constituting the blade pressing-down means 7 presses down the top surface of the blade 10 placed on the blade support portion 332 by the spring action of the spring means 74. Therefore, the blade 10 sandwiched between the blade support portion 332 and the blade pressing-down portion 71 is secured in the blade case 2. When the holding means 3 is closed with the cover means 4 to close the blade case 2, the three leg portions 73 of the blade pressing-down means 7 are fitted into the three escape depressions 332*a* formed between adjacent center hole support portions 331, and the stopper 75 of the blade pressing-down means 7 is fitted to the escape hole 315 formed in the bottom wall 31 to prevent an interference with the leg portions 73.

A description is subsequently given of another embodiment of the blade support means provided on the holding means 3 with reference to FIG. 5.

Figure 5:
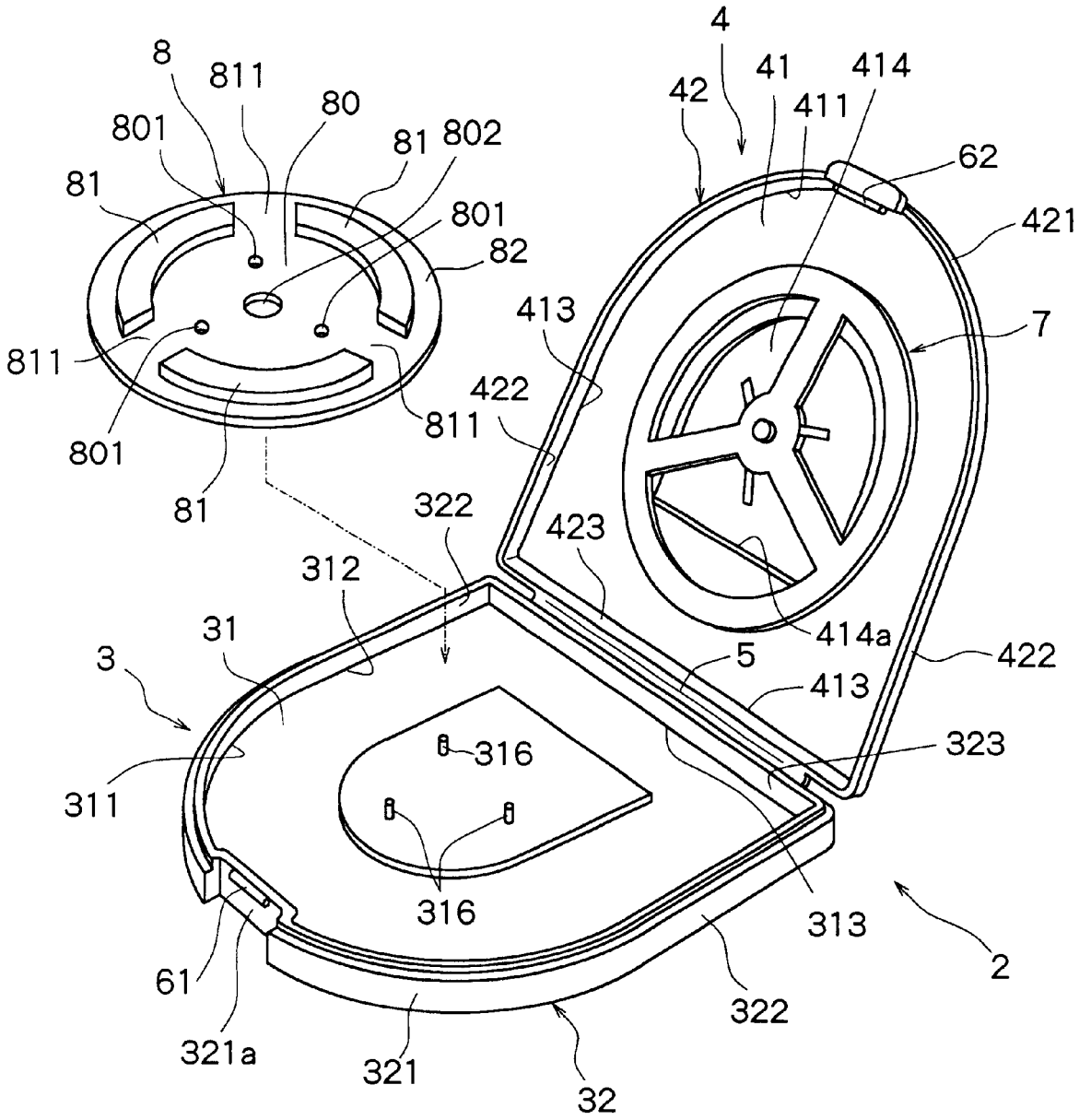
FIG. 5 is a perspective view of another embodiment of a blade support means provided in the blade case shown in FIG. 1.

A blade support means 8 in the embodiment shown in FIG. 5 is constructed separately from the bottom wall 31 constituting the holding means 3. That is, the blade support means 8 has a disk-like base portion 80 and three center hole support portions 81 which are formed on the top surface of the base portion 80 by dividing an annular protruded portion into three by three escape depressions 811 provided at angular intervals of substantially 120°. The outer peripheral surfaces of the three center hole support portions 81 are formed as an arcuate surface having a radius corresponding to the radius of the center hole 10*a* of the blade 10. A portion on the outside of the center hole support portions 81 of the base portion 80 functions as a blade supporting portion 82. Three support holes 801 are formed in the base portion 80 of the thus formed blade support means 8. Three support projections 316 are provided on the center top surface of the bottom wall 31 constituting the holding means 3, corresponding to the three support holes 801. The three support holes 801 formed in the base portion 80 are fitted to the respective three support projections 316 provided on the bottom wall 31 of the holding means 3 so that the blade support means 8 can be mounted on the holding means 3. An escape hole 802 is formed in the center of the base portion 80. Thus, since the blade support means 8 is formed separately from the holding means 3 and can be attached to or detached from the holding means 3 in the blade case in the illustrated embodiment, several types of blade support means 8 which differ in the outer diameter of the center hole support portion 81 are prepared and exchanged according to the diameter of the center hole of the blade, thereby making it possible to store blades which differ in the diameter of the center hole securely without causing looseness. It is preferable that several types of blade pressing-down means 7 which differ in the outer diameter of the blade pressing-down portion 71 are also prepared and exchanged correspondingly to a blade to be stored.

Since the blade case of the present invention is constituted as described above, the following function and effect are obtained.

That is, according to the present invention, since the blade case of the present invention comprises a blade pressing-down means for pressing down the blade placed on the blade supporting portion in a closed state that the holding means is closed with the cover means, the blade is sandwiched between the blade support portion and the blade pressing-down means and reliably secured in a state of being held in the blade case. Therefore, as the blade securely fixed in the blade case has no looseness, the blade can be prevented from breakage during transportation.

The above blade pressing-down means has a blade pressing-down portion for pressing down the blade and a spring means for urging the blade pressing portion so that the blade is pressed by the spring force of the spring means, whereby the blade is fixed more surely.

Since the center hole support portion and the blade supporting portion constituting the above blade support means are formed as a unitary structure, and can be attached to or detached from the bottom wall of the holding means, several types of the blade support means which differ in the diameter of the center hole support portion are prepared and suitably selected according to the diameter of the center hole of the blade, thereby making it possible to store blades which differ in the diameter of the center hole. Thus, since only blade support means may be prepared correspondingly to the different diameters of the center holes of the blades, the present invention is more economical than the prior art in which it is necessary to prepare several types of blade cases corresponding to the diameters of the center holes of blades to be stored.

Further, the outer peripheries of the above holding means and cover means have at least one straight portion, and the straight portions of the holding means and the cover means are connected to each other by a hinge so that the blade case can be opened or closed. Therefore, as a straight portion is formed at the outer periphery of the blade case, the blade case hardly rolls and can be prevented from falling from a table, for example.

Since a non-circular depression is formed in the bottom wall of the above holding means and a non-circular protrusion to be fitted to the depression is formed on the top wall of the above cover means, when several blade cases are piled up, the rotations of the blade cases of which the depression and protrusion are fitted to each other are restricted, thereby making it possible to keep the blade cases piled up together, which is convenient for transportation and storage.

According to the present invention, as the above holding means, cover means and hinge are molded as a unitary structure from polypropylene, they can be recycled.

What is claimed is:

1. A blade case for storing an annular blade having a center hole, which comprises a holding means having a bottom wall and a side wall formed upright from the periphery of the bottom wall and a cover means having a top wall and a side wall extending downward from the periphery of the top wall, the side wall being connected to the side wall constituting the holding means by a hinge so that the blade case can be opened or closed, wherein the blade case further comprises:

a blade support means including a center hole support portion which is provided on the center top surface of the bottom wall of the holding means and to which the center hole of the blade is fitted and a blade supporting portion, formed on the outside of the center hole support portion, for placing the blade fitted to the center hole support portion;

a blade pressing-down means which is provided on the cover means and presses down the blade placed on the blade supporting portion when in a closed state;

a locking means which is formed on the side wall of the holding means and the side wall of the cover means; and a non-circular depression is formed in the bottom wall of the holding means and a non-circular protrusion to be fitted to the depression is formed on the top wall of the cover means.

2. The blade case of claim 1, wherein the blade pressing-down means comprises a blade pressing-down portion for pressing down the blade and a spring means for urging the blade pressing-down portion.

3. The blade case of claim 1, wherein the center hole support portion and the blade supporting portion constituting the blade support means are formed as a unitary structure and can be attached to or detached from the bottom wall of the holding means.

4. The blade case of claim 1, wherein the peripheries of the holding means and the cover means have at least one straight portion, and the holding means and the cover means are connected to each other by a hinge at the straight portion so that the blade case can be opened or closed.

5. The blade case of claim 1, wherein the holding means, cover means and hinge are molded from polypropylene as a unitary structure.

6. The case according to claim 1, wherein there is one non-circular depression and one non-circular protrusion.

7. A blade case for storing an annular blade having a center hole, which comprises a holding means having a bottom wall and a side wall formed upright from the periphery of the bottom wall and a cover means having a top wall and a side wall extending downward from the periphery of the top wall, the side wall being connected to the side wall constituting the holding means by a hinge so that the blade case can be opened or closed, wherein the blade case further comprises:

a blade support means including a center hole support portion which is provided on the center top surface of the bottom wall of the holding means and to which the center hole of the blade is fitted and a blade supporting portion, formed on the outside of the center hole support portion, for placing the blade fitted to the center hole support portion;

a blade pressing-down means which is provided on the cover means and presses down the blade placed on the blade supporting portion when in a closed state; and a locking means which is formed on the side wall of the holding means and the side wall of the cover means;

wherein the center hole support portion and the blade supporting portion constituting the blade support means are formed as a unitary structure and can be attached to or detached from the bottom wall of the holding means.

8. The blade case of claim 7, wherein the blade pressing-down means comprises a blade pressing-pressing down portion for pressing down the blade and a spring means for urging the blade pressing-down portion.

9. The blade case of claim 7, wherein the peripheries of the holding means and the cover means have at least one straight portion, and the holding means and the cover means are connected to each other by a hinge at the straight portion so that the blade case can be opened or closed.

10. The blade case of claim 7, wherein a non-circular depression is formed in the bottom wall of holding means and a non-circular protrusion to be fitted to the depression is formed on the wall of the cover means.

11. The blade case of claim 7, wherein the holding means, cover means, and hinge are molded from polypropylene as a unitary structure.

* * * * *